US011787031B1

(12) United States Patent
Cutting

(10) Patent No.: US 11,787,031 B1
(45) Date of Patent: Oct. 17, 2023

(54) MULTI-FUNCTIONAL DRYWALL IMPLEMENT

(71) Applicant: Lloyd D. J. Cutting, Burnaby (CA)

(72) Inventor: Lloyd D. J. Cutting, Burnaby (CA)

( * ) Notice: Subject to any disclaimer, the term of this patent is extended or adjusted under 35 U.S.C. 154(b) by 228 days.

(21) Appl. No.: 15/866,551

(22) Filed: Jan. 10, 2018

(51) Int. Cl.

| | |
|---|---|
| ***B25F 1/04*** | (2006.01) |
| ***B44D 3/16*** | (2006.01) |
| ***B25G 1/08*** | (2006.01) |
| ***B25G 1/04*** | (2006.01) |

(52) U.S. Cl.
CPC ..... *B25F 1/04* (2013.01); *B25G 1/043* (2013.01); *B25G 1/085* (2013.01); *B44D 3/164* (2013.01)

(58) Field of Classification Search
CPC . B25B 15/00; B25B 15/02; B25F 1/02; B25F 1/04; B25G 1/043; B25G 1/085; B44D 3/164; B44D 3/162
USPC ..... 7/105
See application file for complete search history.

(56) References Cited

U.S. PATENT DOCUMENTS

| | | | | |
|---|---|---|---|---|
| 5,251,352 | A * | 10/1993 | Cullison | B25F 1/04 30/169 |
| 5,870,786 | A * | 2/1999 | Papadopoulos | B25C 11/00 7/105 |
| 6,006,384 | A * | 12/1999 | Toal | B44D 3/164 7/105 |
| 6,530,098 | B1 * | 3/2003 | Gringer | B25F 1/00 7/105 |
| 2004/0231058 | A1 * | 11/2004 | Stubbs | B25F 1/04 7/158 |
| 2007/0131070 | A1 * | 6/2007 | Hull | B25G 1/043 81/489 |
| 2015/0246439 | A1 * | 9/2015 | Raymond | B25F 1/00 7/165 |

* cited by examiner

*Primary Examiner* — Brian D Keller
*Assistant Examiner* — Abbie E Quann
(74) *Attorney, Agent, or Firm* — CRAMER PATENT & DESIGN, PLLC; Aaron R. Cramer

(57) ABSTRACT

A multi-functional tool includes a multi-flanged body and an auxiliary implement attached thereto for assisting a user to install drywall. In use, the tool is attached over the end of a drywall tool and is secured in place. A first end of the tool provides a surface to aid in driving nails, removing obstructions and the like. The opposite second end provides a hex holder to hold a screwdriver bit to aid in recessing any drywall screws that need recessed.

1 Claim, 5 Drawing Sheets

MULTI-FUNCTIONAL DRYWALL IMPLEMENT

Field of the Invention

This invention relates to hand tools and, more particularly, to a multi-functional tool for assisting a user to install drywall in a building structure.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. One (1) type of work common to new construction, remodeling, repair, general maintenance and the like is that of drywall work.

While a minimum of tools is needed for such work, they are utilized almost continuously. Perhaps three (3) of the most common are the putty knife, the hammer and the Phillips screwdriver. A worker must constantly flip back and forth between all of these tools to complete a task. However, such tools are not always handy, forcing the worker to stop what he or she is doing and look for them. Such lost time results in lost income for a contractor and aggravation for the casual user. Accordingly, there is a need for a means by which one (1) drywall tool can be afforded the functionality of multiple drywall tools.

SUMMARY OF THE INVENTION

In view of the foregoing disadvantages inherent in the prior art, it has been observed that there is need for a multi-functional tool for assisting a user to install drywall in a building structure.

The apparatus comprises a tool comprising an obliquely shaped body and an auxiliary implement which is removably coupled directly to the handle receiving aperture, the auxiliary implement being axially centered with the upper body portion and medially disposed between the fastener receiving end. The obliquely shaped body comprises an upper body portion, a lower body portion, a fastener receiving end disposed within a bottom side of the lower body portion, a hammering end disposed within a first side of the upper body portion and a handle receiving aperture disposed within the lower body portion. The hammering end is monolithically formed within the upper body portion. In a separate embodiment, the hammering end has an arcuate outer surface for smoothing protrusions.

The auxiliary implement may comprise a handle formed at a proximal end and a blade formed at a distal end. The blade may extend longitudinally from the distal end. The proximal end may be slidably interfitted within the handle receiving aperture. The proximal end may maintain a frictional interlocking relationship with the handle receiving aperture during operating conditions such that the auxiliary implement remains fixedly aligned along a longitudinal centerline of the body.

The lower body portion may be further provided with a first fastener aperture disposed adjacent to the handle receiving aperture and spaced therefrom, while the auxiliary implement further may include a second fastener aperture which is formed within the proximal end. The first fastener aperture and the second fastener aperture may be centrally aligned for removably receiving a locking member therethrough such that the auxiliary implement is prohibited from prematurely detaching away from the body.

The upper body portion may also comprise a slot which is disposed within a second side of the upper body portion opposite the hammering end. The slot may be configured to removably receive a fastener bit therein while the fastener bit may be received within the slot, while a distal end of the fastener bit remains outwardly exposed from the body for engaging a work surface.

The fastener bit may comprise one (1) fastener which is selected from a group of fasteners including, but not limited to: a Phillips head screwdriver, a flat head screwdriver, and a polygonal-shaped screwdriver. The slot may comprise a plurality of spring-loaded ball bearings which are housed within and are capable of partially traversing a travel path of the fastener. A plurality of engagement pins may directly abut against the ball bearings when the fastener is inserted into the slot.

The upper body portion may also have a cubby hole which is incorporated in a side wall of the upper body portion which is suitable for slidably engaging and storing the fastener bit during non-operating conditions. The auxiliary implement may comprise one (1) tool selected from a group of tools including, but not limited to: a putty knife, a trowel, and a scraper.

A method for employing the multi-functional tool during drywall installation comprises the steps as follows: first, obtaining a body having a hammering end, a handle receiving end and a fastener bit receiving end; second, inserting a proximal end of an applicator handle into a handle receiving aperture such that the handle is frictionally retained therein; third, attaching an applicator handle to a body wherein the handle linearly extends away from the body; fourth, inserting a fastener bit in a slot to matingly engaging therewith; and last, grasping an exposed end of the handle and selectively utilizing the multi-functional tool as a hammering device, a fastener driving device, and an applicator respectively.

The method may further comprise the steps as follows: first, inserting a locking member into a securing aperture and a hanging aperture of the handle; and, last, securing a bolt within the securing aperture by applying a nut at an opposing end of the bolt. The method may further comprise the additional step of removing a fastener bit from the slot by transversely pulling the fastener bit away from the body.

The method may last comprise the steps as follows: first, removing the bolt from the hanging aperture of the handle and the securing aperture of the body; second, removing a proximal end of the handle from the handle receiving aperture of the body portion by pulling transversely therefrom; and last, storing the handle away from the body for later utilization.

The advantages and features of the present invention will become better understood with reference to the following more detailed description and claims taken in conjunction with the accompanying drawings, in which like elements are identified with like symbols, and in which:

DESCRIPTIVE KEY

Figure 1:
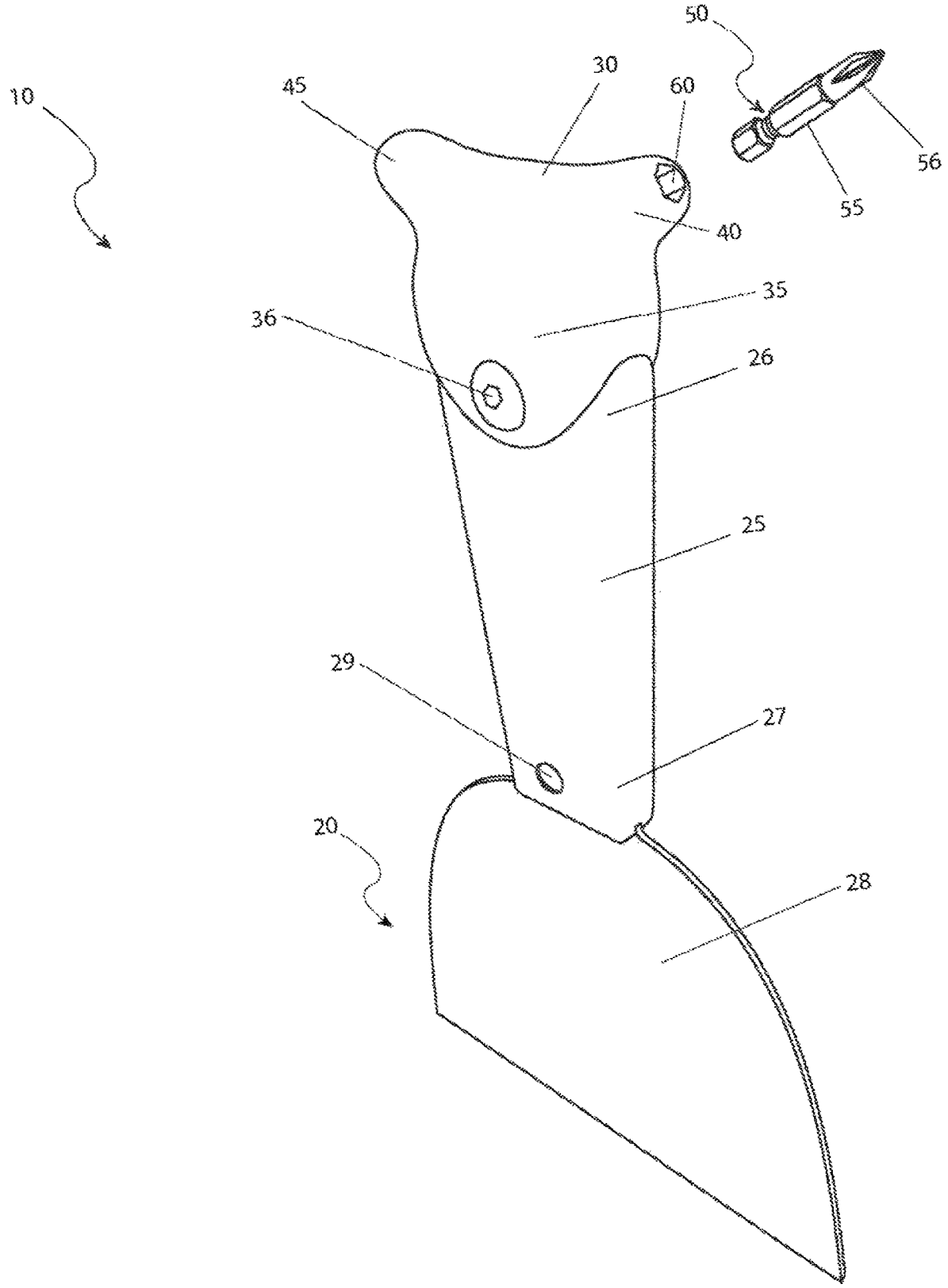
FIG. 1 is a perspective top front right view of a drywall tool 10 and fastener bit 50, according to the preferred embodiment of the present invention.
Figure 2:
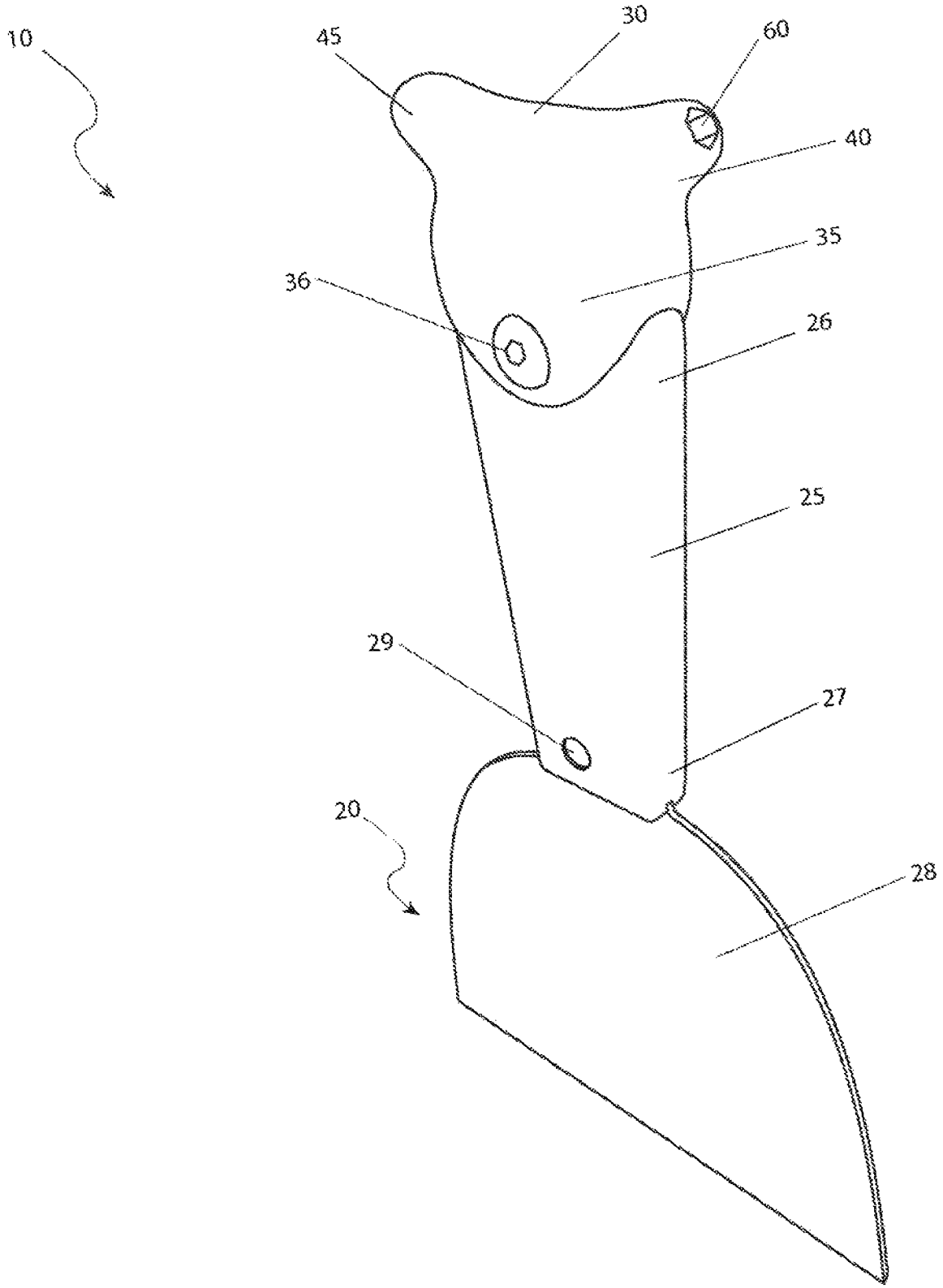
FIG. 2 is a perspective top rear left view of a drywall tool 10, according to the preferred embodiment of the present invention.
Figure 3:
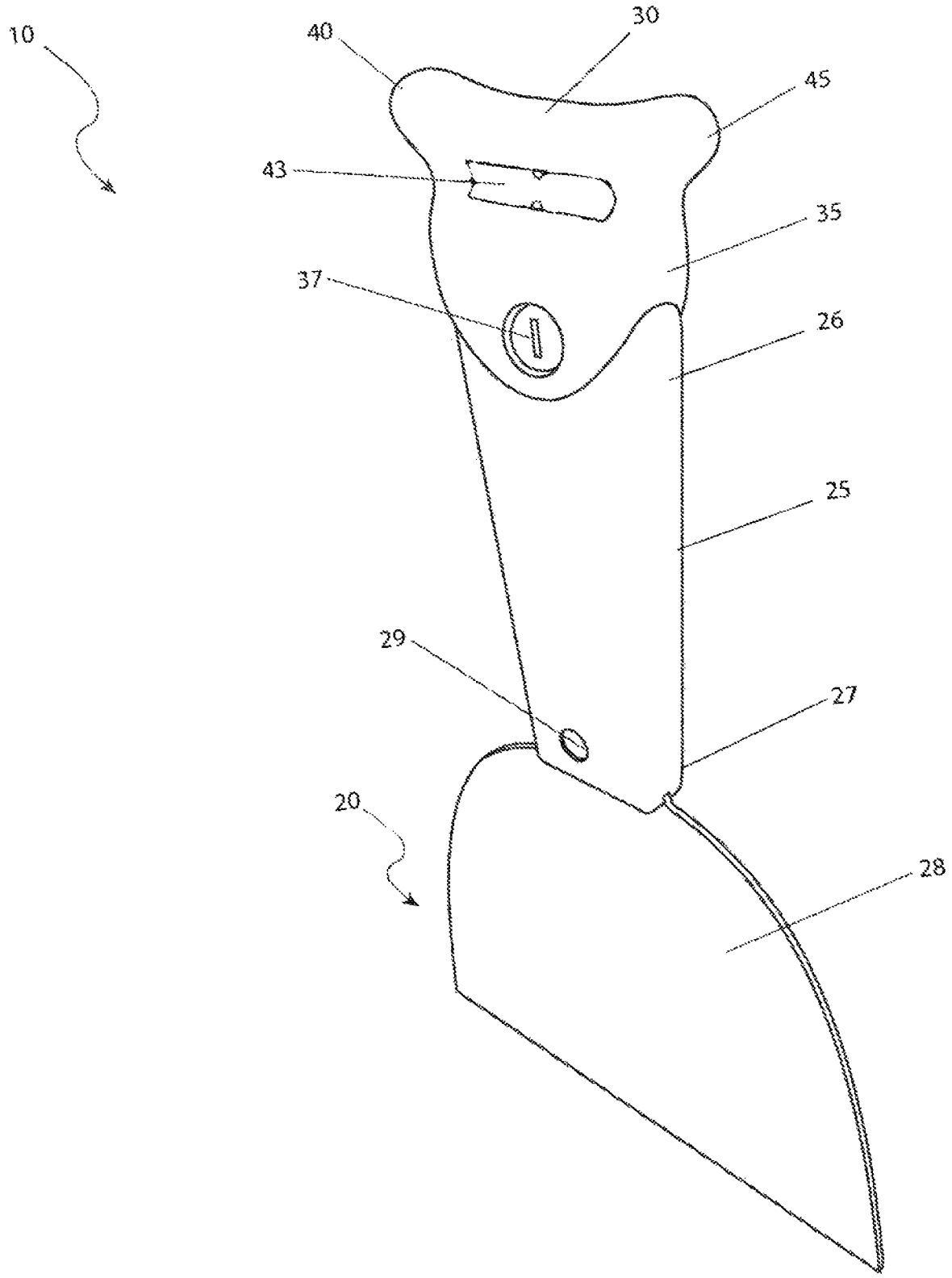
FIG. 3 is a rear view of a drywall tool 10, according to the preferred embodiment of the present invention.

10 drywall tool
20 putty knife
25 handle
26 proximal end
27 distal end
28 blade
29 blade fastener
30 upper body portion
35 lower body portion
36 first tool fastener
37 second tool fastener
38 tool aperture
39 handle aperture
40 screwdriver bit receiving end
41 handle receiving aperture
42 fastener bit retention bearing
43 cubby hole
45 hammering end
50 fastener bit
55 chuck
56 bit head
60 slot

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an apparatus and method that discloses a multi-task drywaller's tool thereby providing a reduction of time and improving installation quality of drywall construction. The drywall tool 10 (herein described as the "apparatus") 10 comprises an upper body portion 30, a lower body portion 35 with first tool fastener 36 therethrough, a screwdriver bit receiving end 40, and a hammering end 45. The apparatus 10 is envisioned to be fabricated of a composition of cast aluminum, titanium, forged spring steel, and/or anodized aluminum coated with rubber, synthetic materials, or the like. The first tool fastener 36 and a second tool fastener 37 removably secures the device apparatus 10 through a first fastener tool aperture 38 in a handle 25 to a handle proximal end 26 when aligned with a second fastener handle aperture 39 disposed within the handle proximal end 26. The blade fastener 29 secures the handle 25 to a putty knife blade 28 at a handle distal end 27.

The hammering portion end 45 and the screwdriver bit receiving end 40 is envisioned to be uncoated with the rubber, synthetic materials, or the like. Further, the hammering portion end 45 may be chrome plated or the like to provide an aesthetically pleasing appearance. It will be appreciated that the materials utilized in the fabrication of the apparatus 10 may vary from a plurality of suitable metallic, rubberized, and/or synthetic materials and may be used separately or a mixture thereof thereby providing the necessary strength for the working environment while providing the option of comprising aesthetically pleasing appearance. Further, the apparatus 10 is envisioned to vary in size, materials, shape, and design as needed.

Figure 4:
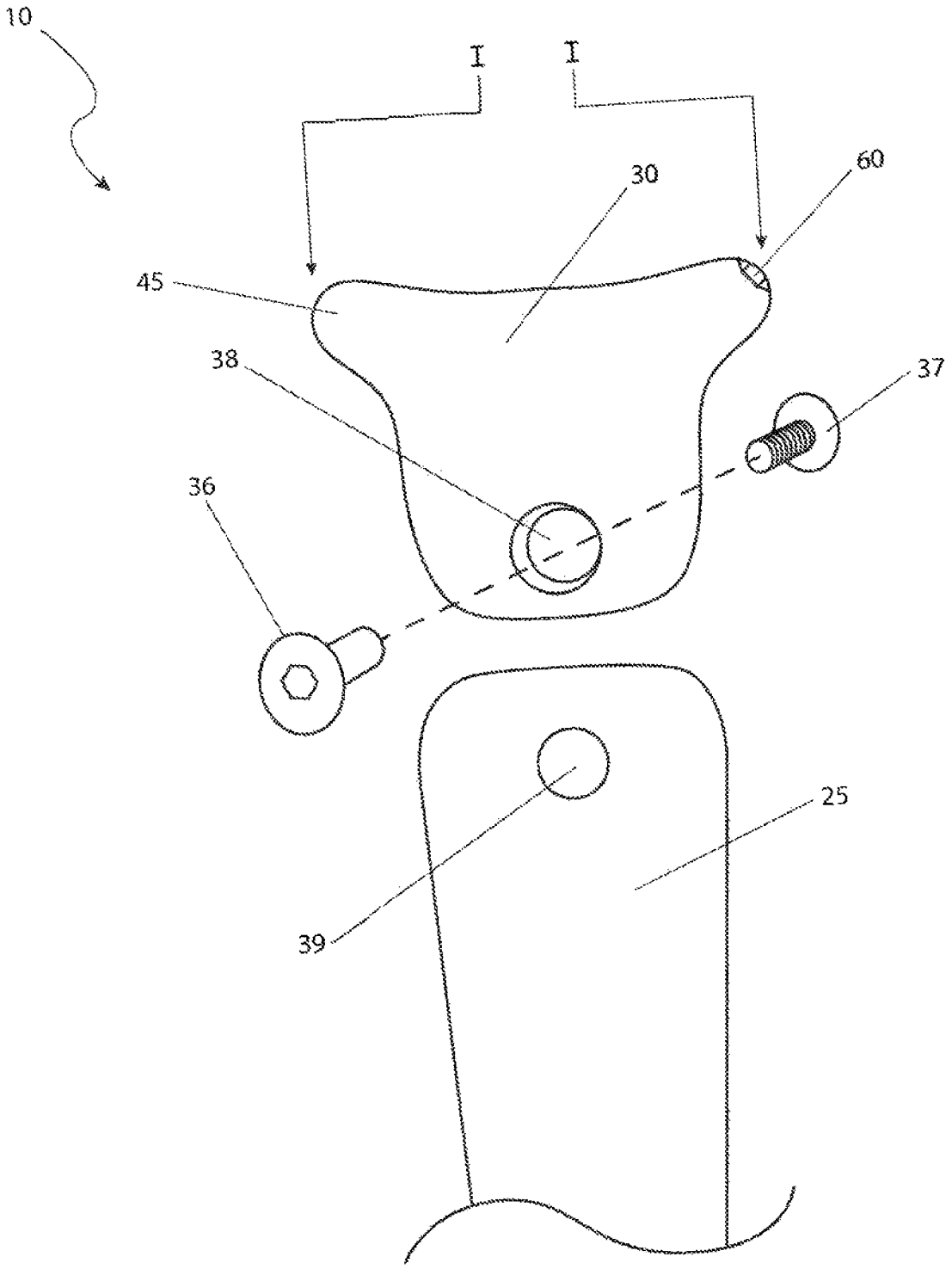
FIG. 4 is a front view of a drywall tool 10, in a detached state, according to the preferred embodiment of the present invention; and, FIG. 5 is a sectional view taken along line I-I from FIG. 4, according to the preferred embodiment of the present invention.
Figure 5:
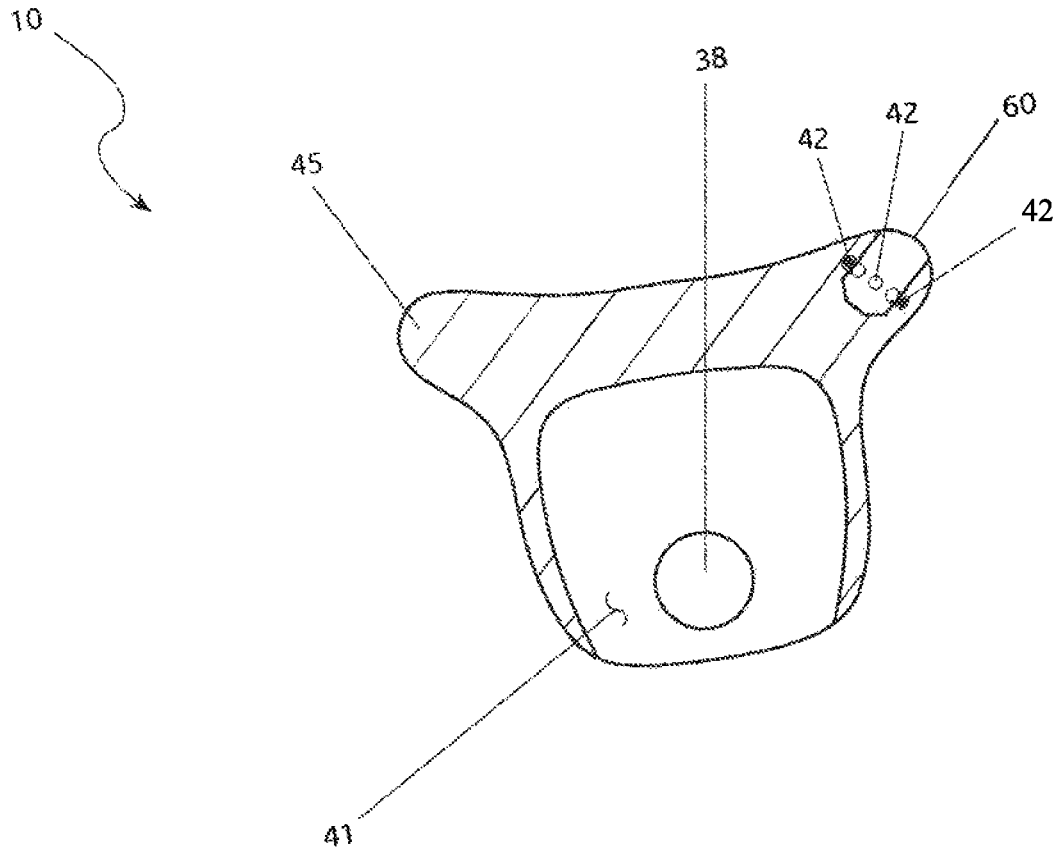

Referring now to FIGS. 1-5, a perspective top front right view of the apparatus 10 and a fastener bit 50, a perspective top rear let view of the apparatus 10, a rear view of the apparatus 10, a front view of the apparatus 10 in a detached state and a sectional view taken along Line I-I from FIG. 4 are respectively disclosed according to the preferred embodiment of the present invention. The apparatus 10 is envisioned to have a handle 25 and a drywall or putty knife 20, a trowel, a scraper, or the like therein.

The putty knife 20 comprises a handle 25 comprising a proximal end 26 and a distal end 27 with a blade 28 extending longitudinally therefrom said distal end 27 and secured thereto by a blade fastener 29. The handle 25 of a putty knife 20 is typically dimensioned to fit the contour of a hand of an adult, thereby providing a conventional size and dimension for said handle 25.

The screwdriver fastener bit 50 is envisioned to be removably received therein a slot 60 or the like at the screwdriver bit receiving end 40. The slot 60 is envisioned to be a chuck 55 that may be a hexagonally-shaped chuck or an otherwise polygonally-shaped chuck to removably receive and engage any hexagonally-shaped chuck or an otherwise polygonally-shaped chuck equipped with bit heads 56 at both ends; although, it is envisioned that the slot 60 may receive and engage any commonly available screwdriver fastener bit 50 such as, but not limited to: a double ended bit comprising a Phillips-head 56 at one (1) end and a slotted bit head 56 at the other end, a Phillips-head bit, a slotted bit, or the like.

The screwdriver bit receiving end 40 is envisioned to incorporate a retaining means to hold the designated screwdriver fastener bit 50 within the slot 60 and allow for ready removability of said screwdriver fastener bit 50, allowing said fastener bit 50 to be replaced with other shaped screwdriver fastener bits 50. The screwdriver bit receiving end 40 is envisioned to comprise two (2) or more spring-loaded ball bearings of a conventional nature, which engage pins of the like configured and dimensioned for cooperative engagement with the tensioned ball bearings when a screwdriver fastener bit 50 is inserted therein the slot 60. Further, a directed translational force will release the screwdriver fastener bit 50, when desired. Other fastener bit 50 retaining means may be acceptable without leaving the scope of the invention apparatus 10. For example, the slot 60 may comprise a magnet or the like adapted to magnetically attract and engage the selected screwdriver fastener bit 50. Although, the slot 60 may comprise a plurality of engaging means as is well known in the art. The hexagonally shaped slot 60 may further be utilized to drive a nut.

The apparatus 10 further comprises a hammering or tamper end 45 designed to capably driving in a nail, screw, or the like, removing obstructions, and/or other job entails.

The design of the hammering or tamper end 45 would sufficiently allow repeated utilization for a plurality of functions such as, but not limited to: recessing drywall nails, removing obstructions, and the like.

The apparatus 10 may be removably secured over the handle 25 through the handle aperture 39 disposed within the handle 25 and when subsequently aligned with the tool aperture 38 disposed within the lower body portion 35. The handle 25 may reside within a handle receiving aperture 41 of the device apparatus 10. The apparatus 10 is then removably secured to the handle 25 when a first tool fastener 36 and second tool fastener 37 are positioned within the tool aperture 38 and the handle aperture 39 and secured to each other. In a separate embodiment, the slot 60 may comprise a plurality of fastener bit retention bearings 42 configured to moveably retain the fastener bit 50 within. In yet another embodiment, the apparatus 10 would comprise a cubbyhole 43 disposed within the upper body portion 30 capable of removably storing the fastener bit 50 therein.

The preferred embodiment of the present invention can be utilized by the common user who has little or no training in a simple and effortless manner. After initial purchase or acquisition of the apparatus 10, it would be configured as indicated in FIGS. 1 through 5.

The method of utilizing the device may be achieved by performing the following steps: acquiring the apparatus 10; inserting the screwdriver fastener bit 50 therein the slot 60 thereby matingly engaging said fastener bit 50 therein the slot 60 for utilization; grasping an exposed handle 25 of the putty knife 20 and utilizing the apparatus 10 as a hammering device, a screw driving device, and/or a putty applying device; removing the fastener bit 50 out of the slot 60 by pulling transversely therefrom, if needed.

Common screwdriver fastener bits 50 comprise a hexagonally-shaped the chuck 55 or the like to be inserted therein the slot 60 such that the head portion 56 of the fastener bit 50 is extending beyond the upper end of the screwdriver bit receiving end 40. On the opposing end of the screwdriver bit receiving end 40 is the hammering end 45 designed to be utilized for driving in recessed nails, removing obstructions, and the like. There hence, the apparatus 10 eliminates the need to replace tools for alternate screwdrivers and wall finishing functions.

The apparatus 10 provides more functionalities within a single tool in which may be utilized with a single hand thereby utilizing the opposing hand to help maintain balance, to hold other work-related items such as a pan of putty or other materials, or the like. For instance, a worker may be utilizing the putty knife 20 to spread drywall putty on drywall and may notice a nail on the wall that require pounding to provide a smoother surface. While still holding the pan of putty or maintaining balance with one (1) hand, the worker can then grasp the exposed handle 25 of the putty knife 20 with the opposing hand and swing the apparatus to provide a levering action to utilize the hammering end 45 to drive in the nails.

Further, the worker may also notice that whilst applying putty or mud utilizing the putty knife 20 that a screw is protruding outwardly and requires tightening. While still holding the pan of putty or maintaining balance with one (1) hand, the worker can then grasp the exposed handle 25 once again and insert the fastener bit 50 into the head of the screw and rotate to tighten said screw providing that the desired interchangeable screwdriver fastener bit 50 is already removably engaged therein the slot 60 positioned at the screwdriver bit receiving end 40.

Another example of an instance may include a worker may occasionally need to remove a drywall screw from a sheet of drywall. The worker may utilize the screwdriver fastener bit 50 removably engaged therewithin the slot 60 as previously indicated, which results in a raised shoulder about the periphery of the hole from which the drywall screw is removed. The worker may turn the apparatus 10 over and utilize the hammering end to pound the raised shoulder to form a dimple within the drywall sheet to which drywall putty may be applied by turning the apparatus 10 over and utilizing the blade 28 of the putty knife 20. As previously mentioned, these are just examples of how useful the apparatus 10 is in instances a common worker may experience while working on the job.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A drywall tool, consisting of: a handle having a proximal end and a distal end; an upper body portion and a lower body portion coupled to the proximal end of the handle; a putty knife blade coupled to the distal end of the handle; a handle aperture disposed on the proximal end of the handle to receive a first tool fastener and a second tool fastener that also extend through a tool aperture disposed on the lower body portion; a blade fastener coupling the putty knife blade to the distal end of the handle; a hammering end disposed on a first side of the upper body portion; a screwdriver bit receiving end disposed on a second side opposite the hammering end disposed on the first side of the upper body portion; a cubby hole disposed on the upper body portion to removably store a fastener bit; a slot disposed on the screwdriver bit receiving end that receives the fastener bit such that a head portion of the fastener bit is extending beyond an upper end of the bit receiving end; wherein the handle aperture aligns with the tool aperture disposed on the lower body portion; wherein the hammering end is chrome plated; wherein the screwdriver bit receiving end is uncoated with one or more rubber or synthetic materials; wherein the slot includes a plurality of fastener bit retention bearings to moveably retain the fastener bit within; wherein the fastener bit is a hexagonally-shaped chuck; and wherein said drywall tool is made of material selected from the group consisting of cast aluminum, titanium, forged spring steel, anodized aluminum coated with rubber, and a plurality of synthetic materials.

* * * * *